US005794921A

United States Patent [19]

Greenberg

[11] Patent Number: 5,794,921

[45] Date of Patent: Aug. 18, 1998

[54] MASONRY FENCE SYSTEM

[75] Inventor: Harold H. Greenberg, Tucson, Ariz.

[73] Assignee: Harold & Edith Greenberg Family Revocable Trust, Prescott, Ariz.

[21] Appl. No.: 652,541

[22] PCT Filed: Nov. 12, 1993

[86] PCT No.: PCT/US93/10892

§ 371 Date: Dec. 27, 1996

§ 102(e) Date: Dec. 27, 1996

[87] PCT Pub. No.: WO95/13442

PCT Pub. Date: May 18, 1995

[51] Int. Cl.[6] ..... E04H 17/14; E02D 27/32

[52] U.S. Cl. ..... 256/19; 52/295; 52/587.1; 52/604

[58] Field of Search ..... 256/19; 52/295, 52/604, 605, 586, 587

[56] References Cited

U.S. PATENT DOCUMENTS

| | | | |
|---|---|---|---|
| 307,586 | 11/1884 | Phillips | 52/604 |
| 2,472,221 | 6/1949 | Malthouse . | |
| 3,512,759 | 5/1970 | Resler . | |
| 3,751,866 | 8/1973 | Renchen . | |
| 3,888,060 | 6/1975 | Haener . | |
| 4,107,889 | 8/1978 | Gonsalves | 52/295 X |
| 4,294,053 | 10/1981 | Lopes | 52/295 |
| 4,726,567 | 2/1988 | Greenberg | 256/19 |
| 5,007,218 | 4/1991 | Bengston et al. | 52/295 X |

*Primary Examiner*—Anthony Knight

*Attorney, Agent, or Firm*—Cahill, Sutton & Thomas P.L.C.

[57] ABSTRACT

A masonry fence system incorporates piers (1) placed at predetermined intervals along a desired fence line. Rigid foundation members (5) extend at grade level (8) between the piers (1) and are supported thereby while supporting courses of masonry block; vertically extending tensioning rods (15) are attached to the foundation members. The post tensioning rods (15) extend upwardly through voids in successive courses of masonry block and terminate in the next to top course of block. A plate (20) and nut (22) are utilized to permit the post tensioning of the rods to transmit compressive forces to the courses of masonry block below. The foundation members (5) may be formed in situ by using bond beam techniques, or may be preformed in predetermined lengths to be transported to the fence site and placed at grade level in contact with the piers (1) at the start of construction.

15 Claims, 3 Drawing Sheets

MASONRY FENCE SYSTEM

FIELD OF THE INVENTION

The present invention relates to masonry block systems, and more particularly, to a masonry fence supported upon piers spaced at predetermined intervals along a desired fence line and incorporating foundation members extending between the piers and having post tensioning rods positioned at spaced intervals along the fence.

BACKGROUND OF THE INVENTION

The installation of a masonry fence heretofore has required the attention of many skilled individuals. The time consumed as well as the materials with which the prior art fences have been made also contribute to the time and expense for the construction of a masonry fence. In U.S. Pat. No. 4,726,567, the utilization of post tensioning rods positioned at spaced intervals along a masonry fence system was described. While the use of such post tensioning techniques permitted savings in materials and labor in the construction of masonry fence without sacrificing structural integrity, this system still required some expensive prior art techniques.

Any reduction in the materials used in the construction of the masonry fence will be represented in savings; however, prior art systems have limited the savings available by the reduction of materials in view of their requirement for the use of footers that required trenching and significant quantities of concrete. Further, techniques used in the construction of such systems frequently required substantial expertise, thus necessitating significant investment in the time required of highly skilled workers such as masons. Indeed, the skill level required in most prior art systems is such that it is nearly impossible for an individual such as a homeowner to install their own masonry fence system.

OBJECTS OF THE INVENTION

It is therefore an object of the present invention to provide a masonry fence system that reduces the cost of materials in the construction of a masonry fence.

It is another object of the present invention to provide a masonry fence system that minimizes or eliminates the need for skilled workers in the construction of the fence system.

It is still another object of the present invention to provide a masonry fence system incorporating foundation members extending between piers along a fence line to permit the elimination of footers with their attendant cost of trenching and significant concrete volume.

It is still another object of the present invention to provide a masonry fence system that greatly simplifies the construction of a masonry fence and enables the fence to be erected without the use of skilled labor, thereby enabling individuals with very little experience to erect their own masonry fence system.

These and other objects of the present invention will become apparent to those skilled in the art as the description thereof proceeds.

SUMMARY OF THE INVENTION

The masonry fence system of the present invention takes advantage of post tensioning techniques described in the above identified patent. The present system eliminates trenching and the pouring of footers and relies instead upon the placement of piers at predetermined intervals along the fence line. Foundation members, which may take any of several different forms, are used and comprise rigid members extending between the piers along the grade level to provide support for the courses of masonry block placed thereon. The foundation members are anchored into the piers, and provide means for connection to post tensioning rods extending vertically from the foundation members. The masonry fence system is then constructed on the foundation members with the post tensioning rods extending through voids in the masonry block. The rods extend through the next-to-top course of the masonry block and are threaded to receive a nut for tightening the rod to thus compress the masonry blocks below. A course of cap block is then placed on the fence system as the top course. Significantly less concrete, substantially less labor, and very little or no skilled labor is required in the construction of the masonry fence thus erected.

BRIEF DESCRIPTION OF THE DRAWINGS

The present invention may more readily be described by reference to the accompanying drawings in which:

Referring to FIGS. 1 through 4, a plurality of piers 1 are provided at predetermined intervals along a fence line, each pier terminates substantially at grade level. The piers 1 provide support for the masonry fence of the present invention while minimizing the amount of concrete necessary in the formation of the fence. The piers may be formed using a conventional auger to form a cylindrical cavity 2; the pier formed by the concrete in the cylindrical cavity provides a grade level bearing surface for the fence in the manner to be described more fully hereinafter. The area of bearing surface may be dictated by relevant building codes or engineering data; however, rather than significantly increase the diameter of the pier 1, and thus require substantially more concrete, diametrically opposed flanges 4 are formed extending along the desired fence line. These flanges can be formed manually using a shovel and, when the pier cavity is filled with concrete, will provide a pier of sufficient mechanical strength and will also provide an appropriate bearing surface area while utilizing a minimum of concrete. In a typical example, a masonry fence may require a sufficient bearing surface on the pier to necessitate the utilization of a 53 cm diameter pier; in contrast, the requirements can be met using a 33 cm diameter cylindrical pier having opposing flanges extending along a diameter of the pier in the direction of the proposed fence line a distance of 15.3 cm with an 20.3 cm width. In the typical example given, the flanges would have a depth of 15.3 cm while the overall depth of the pier would be 107 cm. It may therefore be seen that a substantial savings in the amount of concrete used is provided using the flanges.

In climates requiring consideration of freezing depths in the soil, particularly in northern latitudes, foundations are required to extend to a depth sufficient to avoid the effects of frozen ground. When applied to masonry fencing, such considerations have dictated the requirement that the footers be extended to a sufficient depth to avoid damage by frost or freezing. When design temperatures are very low, the additional depth required of the footers, and the concrete necessary to fill such footers, can represent a significant increase in the cost of masonry fencing. The use of a pier system as described above represents a substantial savings in the cost of installation as well as the cost of materials; the depth to which the piers are placed in the ground to avoid the effects of freezing represents only a fraction of the cost of the prior art technique of trenching and forming a footer to accommodate the same protection against frost or freeze damage.

Figure 1:
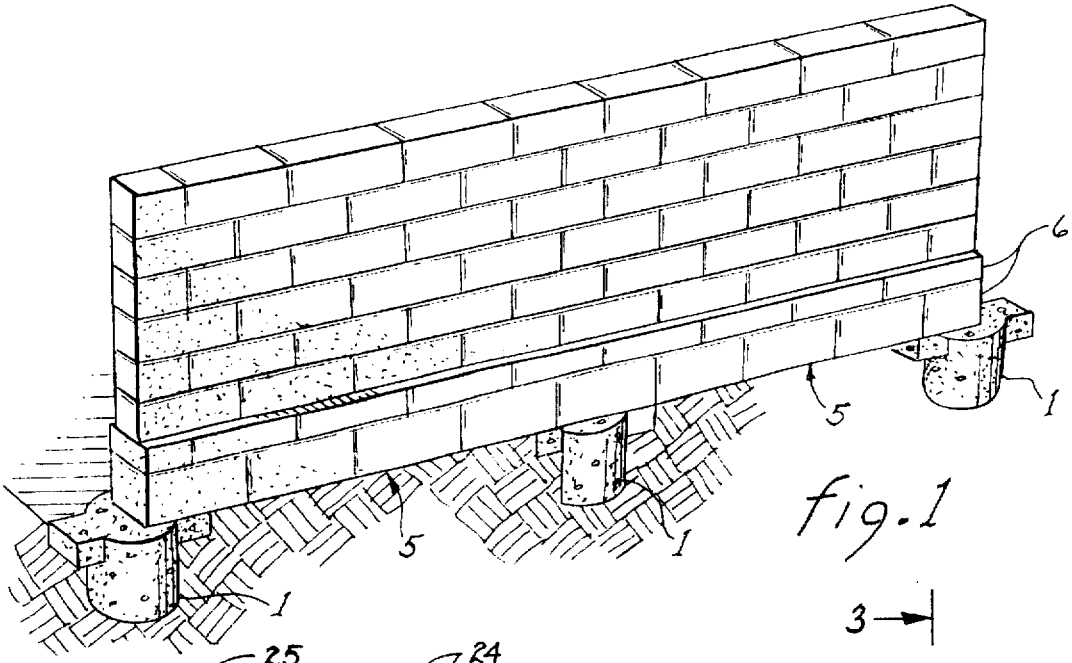
FIG. 1 is an isometric view, partially in section, of a masonry fence system constructed in accordance with the teachings of the present invention.
Figure 3:
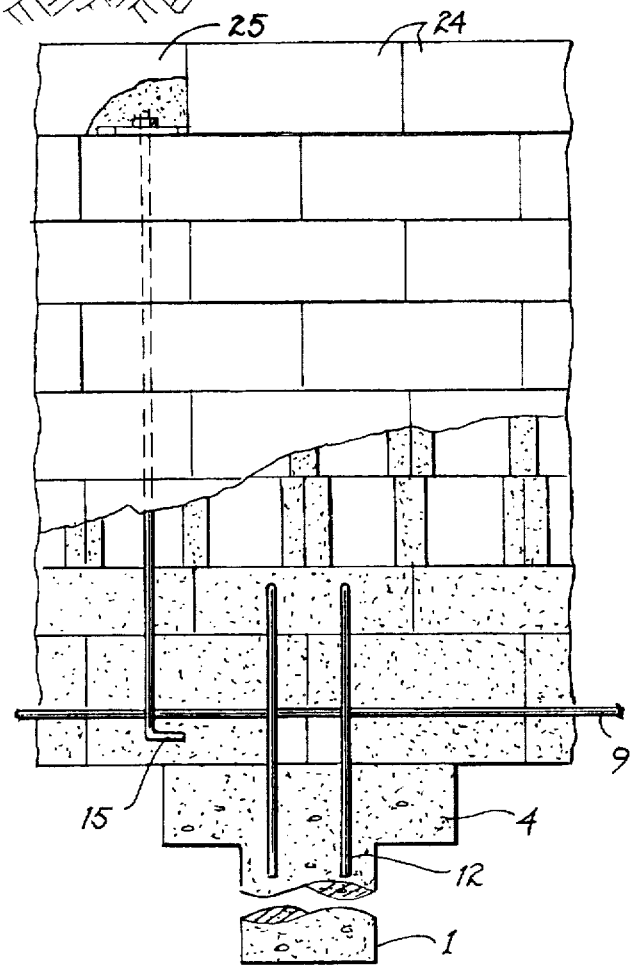
FIG. 3 is a side elevational view of the fence system of FIG. 2.
Figure 2:
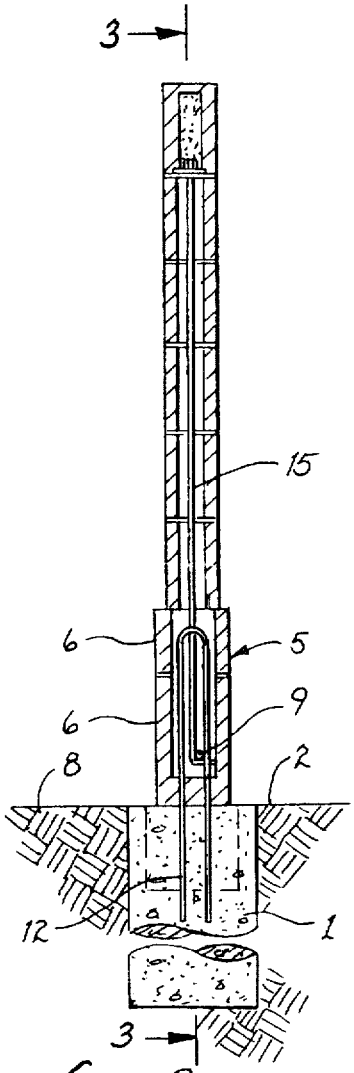
FIG. 2 is a vertical section of the fence system of FIG. 1.
Figure 4:
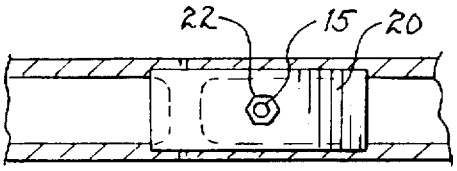
FIG. 4 is a top view of a portion of the fence system of FIG. 2 showing a post tensioning rod and engaging nut contacting a plate for transmitting compressive forces to the masonry fence.

The piers 1 are spaced at predetermined intervals along a desired fence line. Resting above ground at grade level upon the respective piers are a plurality of rigid horizontally extending foundation members 5, each extending between adjacent piers and having opposite ends thereof contacting and supported by the piers substantially at grade level as shown in FIGS. 1, 2 and 3. In some instances, grade level may not be horizontal and if it is determined that a fence contour following the grade level is desired, the foundation members need not necessarily be horizontal. However, in many applications it may be more desirable to follow a sloping grade level by using a stepped wall contour such that the respective piers are positioned at an elevation in accordance with the grade contour and compensation is made to the horizontally extending foundation members to provide appropriate bearing surfaces at the respective ends upon the corresponding piers which may be at different levels. Accordingly, under such stepped wall circumstances the term "substantially at grade level" is intended to mean at a level varying no more than the height of one masonry block.

The foundation members may take a variety of forms; for example, a bond beam such as shown in FIGS. 1 through 3 may form the foundation member by using conventional deep cut bond beam blocks 6 positioned along the grade level 8 extending from one pier to the next and having a reinforcing rod 9 extending horizontally therethrough continuously along the length of the bond beam. The reinforcing bar may be lapped in accordance with typical construction procedures at the ends of the available lengths of the reinforcing bar. Anchor members 12 are formed of metal rods having generally inverted U shapes and are positioned within the bond beam block and extend downwardly into the pier to firmly anchor the bond beam to the pier. The anchors 12 may be inserted into the piers while the concrete forming the latter is plastic; the anchors should be positioned so that they do not contact the inner face of the bond beam blocks 6; to accommodate this requirement, the anchors may be rotated along a vertical axis to be skewed with respect to the vertical planes of the fence.

Post tensioning rods 15 are placed within the bond beam and are hooked beneath the reinforcing bar 9 to permit the post tensioning of the fence structure in a manner to be described. The bond beam block is grouted solid. The spacing between adjacent post tensioning rods will be described more fully hereinafter; however, the tensioning rod spacing and the spacing of the adjacent piers are independent of each other. The bond beam 5 formed as described does not necessarily terminate at each pier; rather, as the beam is formed it presents a continuous rigid beam extending along the length of the fence. Although the example shown in FIGS. 1 through 3 incorporates a continuous bond beam, it is not necessary for the foundation member thus formed to be continuous; that is, the foundation member need not extend along the length of the fence and may take other forms representing rigid horizontally extending members resting upon and supported by piers at opposite ends thereof. Alternative foundation member configurations will be discussed more fully hereinafter.

The masonry fence system of the present invention incorporates post tensioning rods in the manner described in U.S. Pat. No. 4,726,567. In that patent, the use of post tensioning rods was disclosed wherein the rods were anchored at one end in the masonry fence footer and extend through the voids in succeeding courses of masonry block to the next to top course. The system of the present invention also uses post tensioning rods; however, the rods are not imbedded in a footer (no footer exists in the present invention) nor are the tension rods imbedded in the piers. Rather, the post tensioning rods are anchored to the horizontally extending foundation member. In the embodiment incorporating the tension beam or bond beam as the foundation member, the post tensioning rods 15 are imbedded within the beam and are shaped and positioned to hook under the reinforcing bar 9 imbedded within the beam. The post tensioning rods 15 extend upwardly through voids in the masonry block and terminate slightly above the next to top course of the masonry fence system. A steel plate 20 bridges the voids in the masonry block and extends from one side of the block to the other with a hole being provided to admit the passage of the post tensioning rod 15. The upper end of the post tensioning rod 15 is appropriately threaded and a nut 22 is positioned thereon and tightened down against the steel plate 20 to provide a predetermined tension in the rod.

The top course of block may be cap blocks 24; the block 25 directly over the top of the post tensioning rod is filled with mortar and then "flipped" onto the rod to encase the tensioning rod end and nut. When the post tensioning rods are tensioned, the compressive forces are transmitted downwardly and are carried by larger and larger numbers of masonry blocks in each succeeding course. The spacing of the post tensioning rods is independent of the spacing of the piers and will depend on the height of the masonry fence; in the embodiment chosen for illustration the compressive forces from the post tensioning rods are exerted on all of the blocks in the bottom course. It may be seen that the spacing between post tensioning rods is greater in the masonry fence system of the present invention than the system described in the above identified patent since the present system utilizes a foundation member that is rigid and requires no post tensioning forces for structural integrity or strength.

The foundation member 5 described above was formed of bond beam block well known in the industry and is used in the chosen embodiment to contain and position the reinforcing bar and anchors as well as the post tensioning rods as described above. The bond beam block is fully grouted so that the structure forms a unitary rigid beam operating as the foundation member. The bond beam chosen for illustration comprises, for example, two courses of bond beam block of 15.2 cm width and a total of 30.5 cm height. The joints between adjacent bond beam blocks are mortared. The courses of masonry block extending upwardly from the foundation member are self-aligning mortarless block. The latter type of masonry block utilize interlocking configurations to effectively lock the block in position. An example of a suitable self-aligning mortarless block may be seen in U.S. Pat. No. 3,888,060 wherein interlocking ledges are utilized to fix the respective positions of succeeding courses; the blocks may or may not be chamfered.

Figure 5:
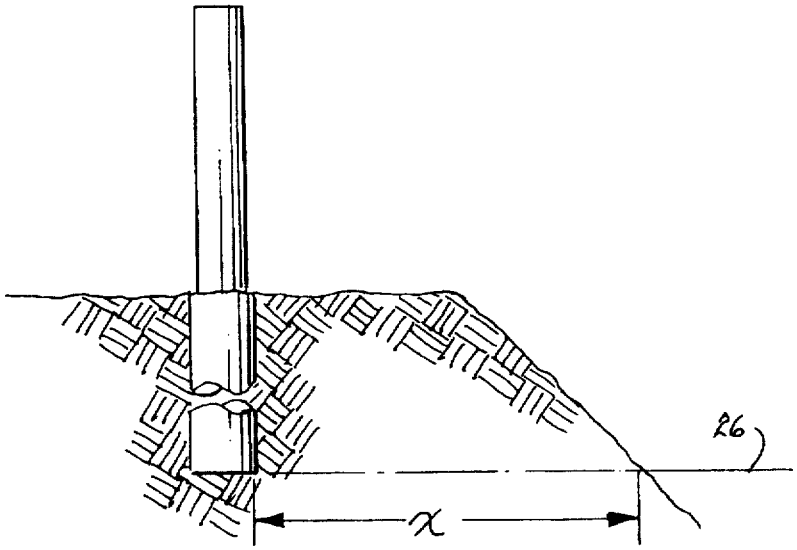
FIG. 5 is a sectional drawing, partially schematic, of the positioning of a masonry fence system constructed in accordance with the teachings of the present invention to more clearly illustrate one of the unexpected advantages of the system.

When a masonry fence is to be placed parallel and adjacent to a sloping grade level such as a ditch, canal, or a natural depression, it is important that the fence be placed appropriately with respect to the sloping grade. Good engineering practice, and indeed building codes, set a minimum distance from the edge of the sloping grade to the face of the fence. Normally, the closer to the fence is placed to the edge, the deeper the fence foundation or footer is required. A typical rule of thumb that is characteristically used in planning the "set back" from a grade slope edge is the "distance to daylight" formula. For example, referring to FIG. 5 the distance X may typically be 1.5 meters; that is, the rules and the code may require that a horizontal line 26 drawn from the bottom of the footer must extend at least 1.5 meters toward the sloping grade before it emerges from below ground. Therefore, the closer the fence is to be positioned to the edge of the depression, the deeper the footer is required to be. With present day masonry fence systems, placing the fence closer to the edge requires a significant increase in the expense of providing the proper footer. A very deep footer trench incorporating a substantial volume greatly increases the cost of the masonry fence both in terms of labor for creating the trench and the cost of materials in the form of concrete to fill the trench. In contrast, the system of the present invention only requires the respective piers to be sunk to the appropriate depth thereby incurring a considerably less increase in expense. The amount of earth thus required to be removed, and the amount of concrete needed to fill the piers of greater depth represents a considerable savings over the present techniques. As a result of the cost savings, fences of a predetermined height can be situated more closely to the edge of the sloping grade without the substantial cost increase required when using existing masonry fence systems.

The foundation members are rigid horizontal structures such as the tension beam or bond beam described above that follows the grade surface while contacting and being supported by adjacent piers. The foundation members may thus be formed in situ by using bond beam techniques wherein bond beam block is laid on the grade along the fence line between adjacent piers; reinforcing rod is then positioned within the blocks and extends horizontally to interconnect the individual blocks. The bond beams are anchored to the piers with anchors extended into the concrete pier (while the concrete is still plastic); the anchors pass over the reinforcing bar within the block. The blocks are solid grouted, thus imbedding the reinforcing bar. Post tensioning rods are placed in the grouting to hook under the reinforcing bar and to extend upwardly from the bond beam at predetermined horizontal positions along the length of the masonry fence.

Figure 6A:
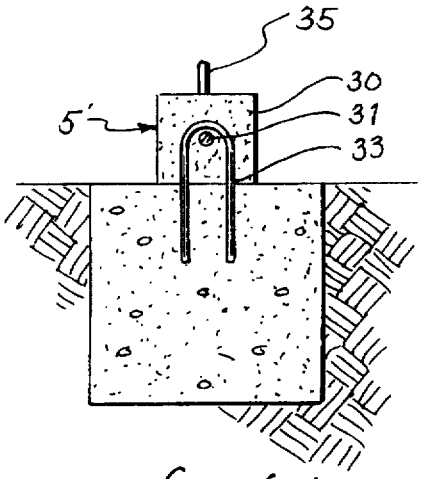
FIGS. 6 and 6A are side elevational and sectional views, respectively, of another embodiment of a foundation member utilized in the system of the present invention.
Figure 6:
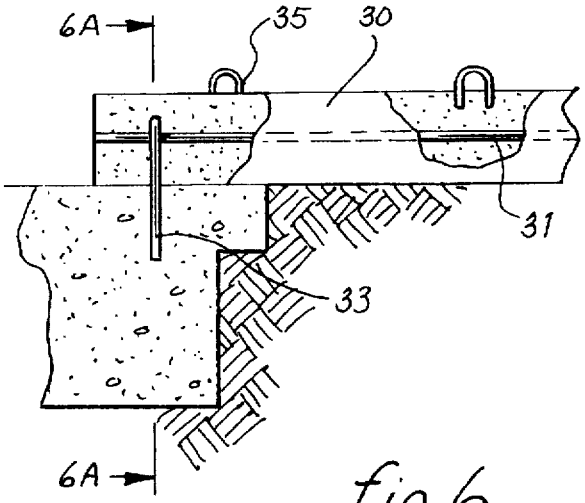

The horizontally extending foundation member thus formed creates a unitary beam supported by the piers and, in turn, supports courses of masonry block positioned on top thereof. The foundation member may take other forms such as a precast tension beam similar to that shown in FIGS. 6 and 6A. The beam 30 may be precast in predetermined lengths to permit positioning the respective beams between adjacent piers; the beams incorporate a reinforcing bar 31 appropriately located within the beam and may also include anchors 33 precast into the beam passing over the reinforcing bar and extending downwardly to subsequently be pushed into the plastic concrete of the respective piers. Post tensioning loops 35 are positioned along the length of the beam at predetermined intervals to permit hooking the bottom end of a post tensioning rod thereto. In this manner, the precast foundation member may conveniently be delivered to the job site and be placed into position and anchored to the respective piers without the use of skilled masons. The resulting foundation member presents the advantages of the bond beam without the necessity of constructing the bond beam in situ.

Figure 7A:
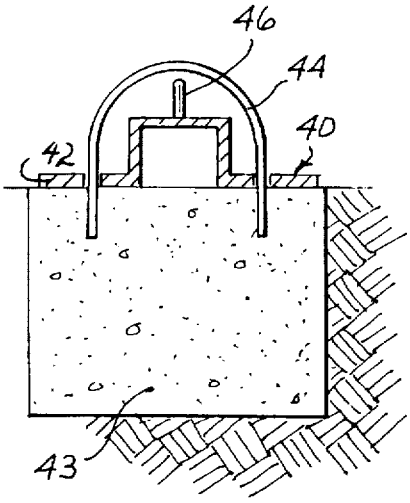
FIGS. 7 and 7A are side elevational and sectional views, respectively, of another embodiment of a foundation member utilized in the fence system of the present invention.
Figure 7:
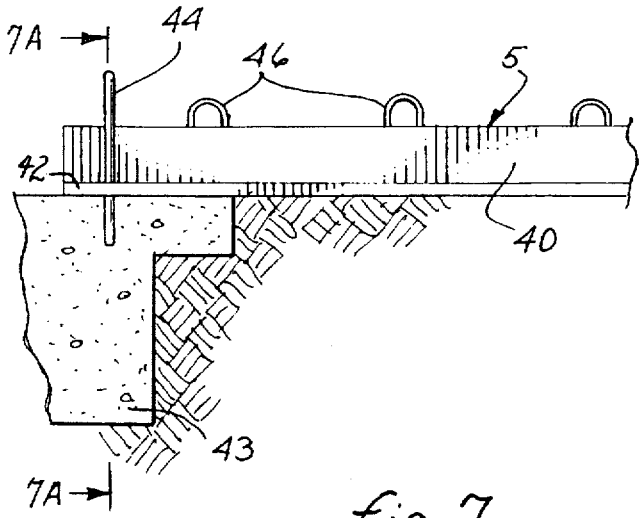

Another form of foundation member may be seen by reference to FIGS. 7 and 7A. A rigid beam or lintel 40 is formed of galvanized steel having a hat-shaped cross section to permit masonry block to be placed thereon (the lintel cross sectional configuration may vary—the rigidity and stiffness of the lintel is important, but other materials may be used, such as aluminum, plastic, or fiberglass). The steel lintel 40 includes flanges 42 that contact and are supported by the pier 43; anchors 44 extend through holes provided in the lintel; the anchors loop over the top of the lintel and extend downwardly to be imbedded in the concrete of the pier. Loops 46 are attached to the lintel, such as by welding, at predetermined intervals along its length to permit connection to post tensioning rods in a manner described above. One of the chief advantages of the lintel form of the foundation member is its light weight. These preconstructed lintel-type foundation members can be transported to the job site and easily placed in position by a single individual. The masonry blocks positioned on the lintel will require an appropriate configuration to permit the longitudinally extending rib of the lintel to pass along the length of the block. Other cross sectional configurations of the lintel may be used; the specific dimensions of the lintel will depend on many factors, including the distance between adjacent piers, the height of the fence and the weight of the masonry block intended to be used.

Figure 8:
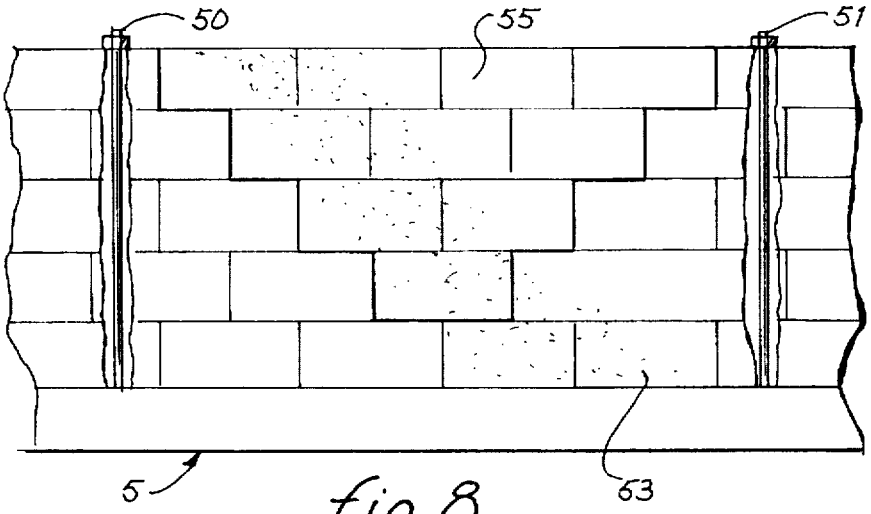
FIG. 8 is a side elevational view partly in section of a masonry fence constructed in accordance with the teachings of the present invention and useful in the explanation of the transmission of compressive forces in the fence system.
Figure 10:
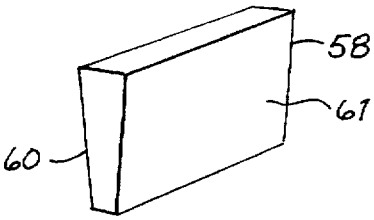
FIG. 10 is a perspective view of a horizontal compression member useful in the construction of the masonry fence system of the present invention.
Figure 9:
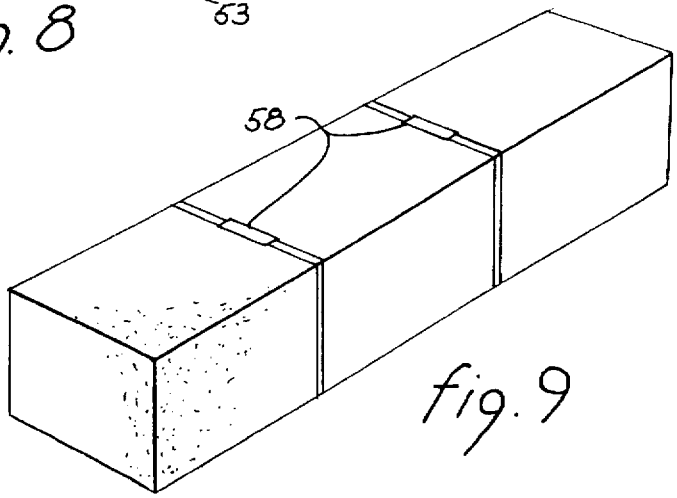
FIG. 9 is a perspective view of selected ones of the masonry block on the next-to-top course of the masonry fence of FIG. 8.

Referring to FIG. 8, a section of fence constructed in accordance with the teachings of the present invention is shown and is partly broken away to reveal post tensioning rods 50 and 51. The top course of the fence is not shown to facilitate the description of the compressive forces acting upon the fence. When the post tensioning rods are appropriately tensioned, compressive force is exerted on the masonry block directly beneath the threaded end of the respective post tensioning rod; the latter masonry block transmits this compressive force to the two blocks therebeneath, which in turn transmits the compressive force to the four blocks below, and so forth until the bottom course of masonry blocks 53 is reached. It may be seen that a group of masonry block roughly forming an inverted triangle 55 escapes the compressive forces being exerted by the post tensioning of the rods 50 and 51. If the masonry fence is mortared, conventional horizontal joint strengthening means may be used, such as wire reinforcement in the manner described in U.S. Pat. No. 4,726,567. However, if the masonry fence is formed utilizing mortarless joints, the interlocking features of the respective blocks may be relied upon to maintain the non-compressed block in place. It has been found, however, that the system can be greatly improved when using self-aligning mortarless block by incorporating horizontal compressive members 58 as shown in FIGS. 9 and 10. The compression members 58 may be formed of galvanized steel or hard plastic and include slightly tapered sides 60 and 61 to permit the members to be placed between the opposing vertical faces of adjacent masonry block. As the horizontal compression members are forced downwardly into the space separating the adjacent masonry block, the corresponding block is placed under compression to substantially increase the frictional force required to displace the block relative to an adjacent block.

By utilizing such horizontal compression members in the top course of the fence (excluding the cap blocks that are placed on top), those blocks that are not subjected to the compressive forces of the post tensioning rods are affectively locked in place. Further, it may not be necessary to utilize such horizontal compression members between each adjacent masonry block; the individual block design, as well as the tolerances presented by such design, will dictate the number of such horizontal compression members. The members may be inserted between the blocks simply by forcing the end between adjacent blocks and then driving them, such as by hammering the members into place to force the tapered surfaces against the opposing masonry block vertical surfaces to create a horizontal compressive force. The horizontal compression members are driven downwardly until the upper surfaces thereof are flush with the upper surfaces of the adjacent masonry block.

The masonry fence system of the present invention therefore provides a fencing system that may be economically installed with a minimum of, and sometimes without, skilled labor; further, materials costs are less than in prior art fence systems. The use of piers rather than conventional footers greatly reduces material costs while also decreasing the labor expense of installation and also greatly simplifies the installation in areas subjected to frost and freezing conditions. Providing flanges on cylindrical piers also permits the use of less concrete while nevertheless providing appropriate bearing surfaces for the fence structure. The rigid foundation members extending between piers combined with post tensioning rods permit the masonry fence to be erected rapidly and with very little expensive skilled labor. If the foundation member is formed by a precast member, or a rigid lintel as described above, an individual with no masonry skill can install his own fence; that is, techniques such as troweling or mortar management will not be necessary. The resulting masonry fence structure will be less expensive while providing the necessary fence strength and integrity.

What is claimed is:

1. A masonry fence system comprising:

(a) a plurality of courses of masonry blocks extending along a fence line;

(b) a plurality of concrete piers each extending into the ground and terminating substantially at grade level to provide a bearing surface, said piers spaced at predetermined intervals along said fence line;

(c) an above ground rigid foundation member extending along grade level between adjacent piers in contact with the bearing surfaces of said piers and supported by said piers substantially at grade level, said foundation member contacting and supporting a bottom course of said fence;

(d) a plurality of anchoring members extending into said piers and secured to said foundation member for anchoring said foundation member to said piers;

(e) a plurality of post tensioning rods spaced along said fence line at selected intervals, each secured at one end thereof to said foundation member and extending upwardly through voids in the masonry block and terminating above a predetermined course of block; and (f) means for tensioning said rods to compress the masonry block.

2. The combination set forth in claim 1 wherein said piers are each formed of a cylindrical column of concrete extending into the ground and having an upper surface terminating substantially at grade level.

3. The combination set forth in claim 1 wherein said piers are each formed of a cylindrical column of concrete extending into the ground and having an upper surface terminating substantially at grade level, and wherein each of said piers includes a pair of flanges formed integrally with said pier and extending along said fence line at said grade level to increase the area of said bearing surface.

4. The combination set forth in claim 1 wherein said rigid foundation member is formed of a plurality of bond beam blocks.

5. The combination set forth in claim 1 wherein said rigid foundation member is formed of a plurality of bond beam blocks and includes a reinforcing bar extending longitudinally of said beam encased in mortar.

6. The combination set forth in claim 1 including a plurality of horizontal compression members positioned between selected adjacent masonry blocks in the next-to-top course of said fence, each horizontal compression member forming a wedge having tapering surfaces to permit the member to be inserted between adjacent blocks to create horizontal compression forces in the next-to-top course of masonry block.

7. A masonry fence system comprising:

(a) a plurality of courses of masonry blocks extending along a fence line;

(b) a plurality of concrete piers each extending into the ground and terminating substantially at grade level to provide a bearing surface, said piers spaced at predetermined intervals along said fence line;

(c) a plurality of above ground rigid foundation members extending along grade level between adjacent piers in contact with the bearing surfaces of said piers and supported by said piers substantially at grade level, each of said foundation members including post tensioning connection means, each of said foundation members contacting and supporting a bottom course of said fence;

(d) a plurality of anchoring members extending into said piers and each secured to one of said foundation members for anchoring said foundation member to said piers;

(e) a plurality of post tensioning rods spaced along said fence line at selected intervals, each secured at one end thereof to the post tensioning connection means of said foundation member and extending upwardly through voids in the masonry block and terminating above a predetermined course of block; and (f) means for tensioning said rods to compress the masonry block.

8. The combination set forth in claim 7 wherein said foundation members are formed of precast concrete having a reinforcing bar therein and said post tensioning connection means are loops anchored in and extending from the foundation members.

9. The combination set forth in claim 7 wherein said rigid foundation members are lintels.

10. The combination set forth in claim 7 wherein said rigid foundation members are galvanized steel lintels.

11. The combination set forth in claim 7 wherein said rigid foundation members are galvanized steel lintels including flanges for contacting and being supported by said piers, and including a plurality of holes provided in said flanges over said piers to permit anchoring means to extend therethrough into said piers.

12. The combination set forth in claim 7 wherein said rigid foundation members are galvanized steel lintels having a hat-shaped cross-section and said post tensioning connection means is a plurality of loops secured to said hat-shaped cross-section for attachment to said post-tensioning rods.

13. A masonry fence system comprising:

(a) a plurality of courses of masonry blocks extending along a fence line;

(b) a plurality of concrete piers each extending into the ground and terminating substantially at grade level to provide a bearing surface, said piers spaced at predetermined intervals along said fence line;

(c) a plurality of above ground rigid foundation members extending along grade level between adjacent piers in contact with the bearing surfaces of said piers and supported by said piers substantially at grade level, each of said foundation members contacting and supporting a bottom course of said fence;

(d) a plurality of anchoring members extending into said piers and each secured to one of said foundation members for anchoring said foundation member to said piers;

(e) a plurality of post tensioning rods spaced along said fence line at selected intervals, each secured at one end thereof to one of said foundation members and extending upwardly through voids in the masonry block and terminating in a threaded end positioned above a predetermined course of block; and (f) means for tensioning said rods to compress the masonry block.

14. The combination set forth in claim 13 including a plurality of nuts each threadedly engaging a respective one of said threaded ends for tensioning said rods to compress the masonry blocks.

15. The combination set forth in claim 13 wherein said anchor members are formed of metal rods having an inverted U-shape.

* * * * *